US009375957B2

(12) United States Patent
Imamura et al.

(10) Patent No.: US 9,375,957 B2
(45) Date of Patent: Jun. 28, 2016

(54) IMAGE RECORDING DEVICE AND IMAGE RECORDING METHOD

(71) Applicant: SEIKO EPSON CORPORATION, Tokyo (JP)

(72) Inventors: Atsushi Imamura, Nagano (JP); Akihiro Toya, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/617,057

(22) Filed: Feb. 9, 2015

(65) Prior Publication Data

US 2015/0251460 A1 Sep. 10, 2015

(30) Foreign Application Priority Data

Mar. 7, 2014 (JP) ..... 2014-044838

(51) Int. Cl.

| | |
|---|---|
| ***B41J 29/38*** | (2006.01) |
| ***B41J 13/00*** | (2006.01) |
| ***B41J 11/42*** | (2006.01) |
| *B41J 15/04* | (2006.01) |

(52) U.S. Cl.

CPC ..... *B41J 13/0009* (2013.01); *B41J 11/425* (2013.01); *B41J 15/04* (2013.01)

(58) Field of Classification Search

CPC ..... B41J 13/0009
USPC ..... 399/328; 347/16, 5, 9; 219/216
See application file for complete search history.

(56) References Cited

U.S. PATENT DOCUMENTS

| | | | | |
|---|---|---|---|---|
| 8,498,560 | B2 * | 7/2013 | Sakaya | G03G 15/2053 219/216 |
| 2012/0242735 | A1 | 9/2012 | Izawa et al. | |
| 2013/0135378 | A1 | 5/2013 | Tanjo et al. | |

FOREIGN PATENT DOCUMENTS

| | | | |
|---|---|---|---|
| JP | 09-267500 | A | 10/1997 |
| JP | 2012-024932 | A | 2/2012 |
| JP | 2012-200976 | A | 10/2012 |
| JP | 2013-116786 | A | 6/2013 |

* cited by examiner

*Primary Examiner* — Lam Nguyen
(74) *Attorney, Agent, or Firm* — Global IP Counselors, LLP

(57) ABSTRACT

An image recording device includes a drive roller that conveys a recording medium by rotating, a driven roller that grasps the recording medium between it and the drive roller, a recording unit capable of recording an image on the recording medium arranged further to the downstream side than the drive roller in a first direction which is the recording media conveyance direction, and a control unit that records an image on the recording media while conveying the recording media in the first direction. The control unit, when the conveying of the recording media in the first direction stops, starts conveying the recording media in a second direction which is the reverse direction of the first direction, and stops conveying of the recording media in the second direction in a state with the image recorded on the recording media positioned between the drive roller and the driven roller.

7 Claims, 5 Drawing Sheets

| Base Material | Nip Load | Nip Time | | | | | | |
|---|---|---|---|---|---|---|---|---|
| | | 1 sec. | 2.5 sec. | 4.6 sec. | 5 sec. | 6.8 sec. | 10 sec. | 61.4 sec. |
| #76911 | 200N | ○ | | | △ | | △ | × |
| | 100N | ◎ | ◎ | ○ | ○ | ○ | ○ | △ |
| | 70N | ◎ | | | ○ | | | △ |

◎: Invisible
○: Almost Invisible
△: Slightly Visible
× : Visible

IMAGE RECORDING DEVICE AND IMAGE RECORDING METHOD

CROSS-REFERENCE TO RELATED APPLICATIONS

This application claims priority to Japanese Patent Application No. 2014-044838 filed on Mar. 7, 2014. The entire disclosure of Japanese Patent Application No. 2014-044838 is hereby incorporated herein by reference.

BACKGROUND

1. Technical Field

The present invention relates to an image recording device and an image recording method for conveying media while grasping the recording media with a drive roller and a driven roller.

2. Related Art

The printer of Japanese Unexamined Patent Publication No. 2013-116786 records an image on a sheet using a recording head arranged to the downstream side in the conveyance direction in relation to the drive roller while conveying the sheet in the conveyance direction by rotating a drive roller. In particular, this printer is equipped with a nip roller that grasps the sheet between it and the drive roller, and conveys the sheet while ensuring friction force between the drive roller and the sheet.

SUMMARY

However, with the kind of printer noted above, conveying of the recording media is stopped as appropriate. At this time, by unrecorded recording media being stopped for a long time between the drive roller and the nip roller, the unrecorded recording media that was positioned between the drive roller and the nip roller degenerates. As a result, it is not possible to do a good recording of the image on the degenerated part with image recording after that, and there were cases when the image quality of the image recorded on the degenerated part decreased.

The present invention was created considering the problem noted above, and an object is to provide an image recording device and an image recording method capable of inhibiting a decrease in the image quality with an image recording device and image recording method that convey recording media while grasping it between a drive roller and a driven roller.

An image recording device according to one aspect includes a drive roller, a driven roller, a recording unit, and a control unit. The drive roller is configured and arranged to convey a recording medium by rotating. The driven roller is configured and arranged with respect to the drive roller so that the recording medium is grasped between the drive roller and the driven roller. The recording unit is configured and arranged to record an image on the recording medium arranged further to a downstream side than the drive roller in a first direction which is a recording medium conveyance direction. The control unit is configured to control the recording unit and the drive roller to record the image on the recording medium while conveying the recording medium in the first direction. The control unit is configured to control the recording unit and the drive roller to stop conveying of the recording medium in the first direction and to start conveying the recording medium in a second direction which is a reverse direction of the first direction, and to stop conveying of the recording medium in the second direction in a state in which the image recorded on the recording medium is positioned between the drive roller and the driven roller.

An image recording method according to another aspect includes: recording an image on a recording medium by a recording unit arranged further to a downstream side in a first direction than a drive roller while conveying the recording medium grasped between the drive roller and a driven roller in the first direction which is a conveyance direction of the recording medium; starting conveying of the recording medium in a second direction which is a reverse direction of the first direction when conveying of the recording medium in the first direction stops; and stopping conveying of the recording medium in the second direction in a state in which the image recorded on the recording medium is positioned between the drive roller and the driven roller.

With the above aspects (image recording device and image recording method) constituted in this way, an image is recorded on recording media by the recording unit arranged further to the downstream side in the first direction than the drive roller while recording media grasped between the driven roller and the drive roller is conveyed in the first direction (conveyance direction of the recording media). With this constitution, when conveying of the recording media in the first direction is stopped, the unrecorded recording media is stopped between the drive roller and the driven roller. Because of that, if the time for which the conveying of the recording media is stopped becomes long, there is the risk of the problem described above occurring.

In contrast to this, with the above aspects, when conveying of the recording media in the first direction stops, conveying of the recording media in the second direction that is the reverse direction to the first direction starts. Then, in a state for which the image recorded on the recording media is positioned between the drive roller and the driven roller, conveying of the recording media in the second direction is stopped. Therefore, the time for which the unrecorded recording media is stopped between the drive roller and the driven roller can be suppressed to the time from when the conveying in the first direction stops until the conveying in the second direction starts, and it is possible to inhibit a decrease in image quality.

At this time, it is also possible to constitute the image recording device so that the control unit is configured to control the drive roller to start conveying the recording medium in the second direction within 2.5 seconds after conveying of the recording medium in the first direction stops. With this constitution, it is possible to inhibit the time for which the unrecorded recording media is stopped between the drive roller and the driven roller to within 2.5 seconds. As a result, it is possible to more reliably inhibit a decrease in image quality.

It is also possible for the image recording device to be constituted so as to be equipped with: an exterior member housing the drive roller, the driven roller, and the recording unit; a door provided on the exterior member; a locking mechanism configured and arranged to lock the door; and a user interface configured and arranged to receive instructions from a user and to transmit the instructions to the control unit. The control unit is configured to control the drive roller to stop conveying of the recording medium in the first direction in accordance with a stop instruction from the user, to control the locking mechanism to lock the door until conveying of the recording medium in the second direction stops, and to unlock the door after conveying of the recording medium in the second direction has stopped. With this constitution, it is possible to prevent access by a user to the interior of the exterior member by locking the door until conveying of the recording media in the second direction stops, and after conveying of the recording media in the second direction stops, it is possible for the user to realize a desired task on the interior of the exterior member by having the door unlocked.

It is also possible for the image recording device to be constituted so as to be equipped with an irradiation unit configured and arranged to irradiate light on the recording medium, wherein the recording unit is configured and arranged to discharge a photocurable liquid that is cured by irradiating the light to record the image on the recording medium, and the control unit is configured to control the recording unit, the drive roller and the irradiation unit to stop conveying of the recording medium in the first direction after having the image cured to a level at which the image will not transfer to the driven roller when the image contacts the driven roller, by irradiating the light from the irradiation unit on the image recorded on the recording medium by the recording unit. With this constitution, conveying of the recording media in the first direction is stopped after curing the image recorded on the recording media. Therefore, the image positioned between the drive roller and the driven roller due to conveying of the recording media in the second direction after that is cured by irradiation of light. Thus, it is possible to inhibit dirtying of the driven roller by contact with the uncured image.

It is also possible for the image recording device to be constituted such that the driven roller has rubber on an outer circumference surface, and a surface of the recording medium on which the image is recorded is contacted by the outer circumference surface. With this constitution, it is easy for the decrease in image quality described above to occur on the recording media. In light of that, it is preferable to inhibit the decrease in image quality by applying the present invention.

It is also possible for the image recording device to be constituted such that the driven roller has a tetrafluoro ethylene perfluoro alkyl vinyl ether copolymer on an outer circumference surface, and a surface of the recording medium on which the image is recorded is contacted by the outer circumference surface. With this constitution as well, there are cases when the decrease in image quality described above occurs. In light of that, it is preferable to inhibit the decrease in image quality by applying the present invention.

BRIEF DESCRIPTION OF THE DRAWINGS

Referring now to the attached drawings which form a part of this original disclosure:

FIG. 2 is a perspective view schematically showing the exterior member the printer is equipped with.

DETAILED DESCRIPTION OF EXEMPLARY EMBODIMENTS

Figure 1:
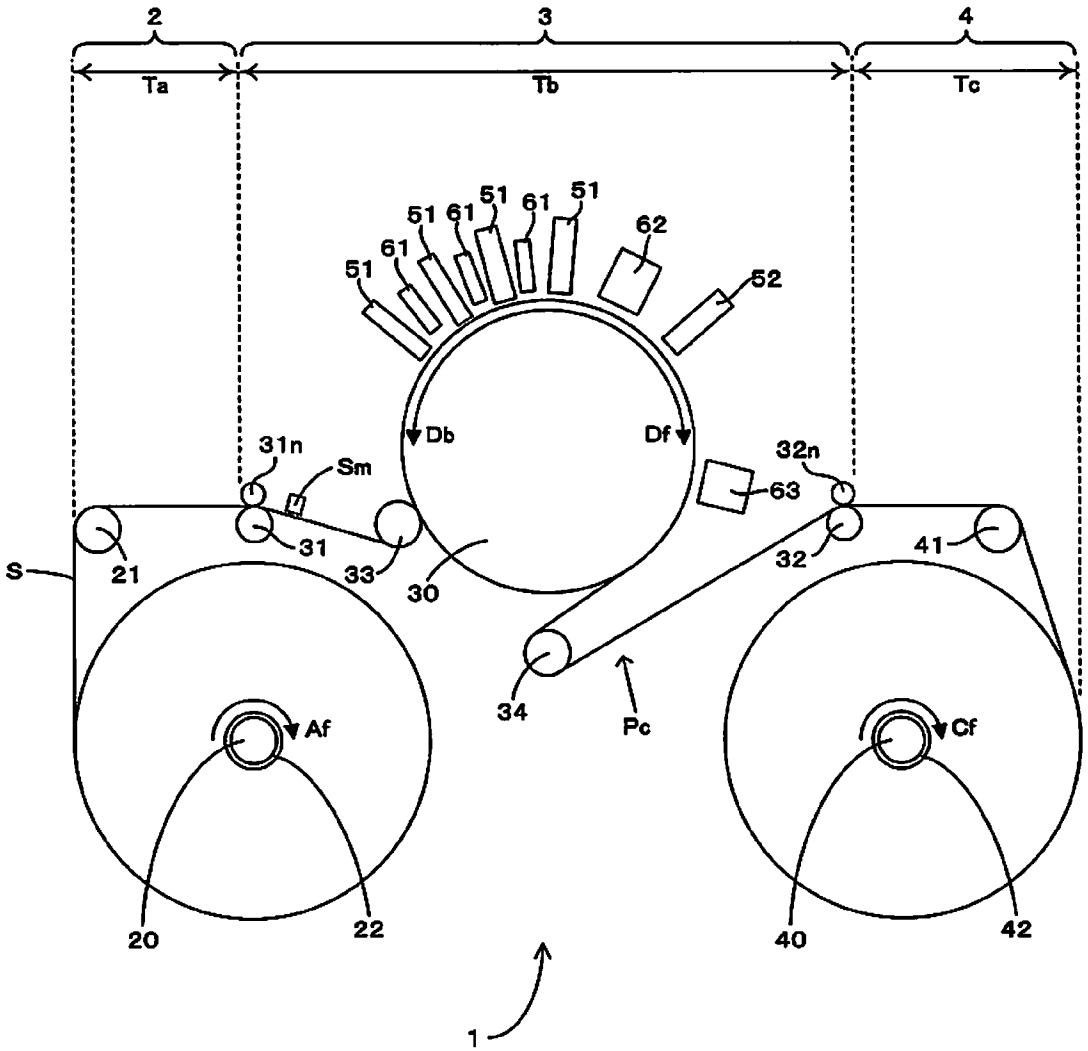
FIG. 1 is a front view schematically showing the device configuration with which a printer that can execute the present invention is equipped.

FIG. 1 is a front view schematically showing an example of a device constitution equipped with a printer capable of executing the present invention. As shown in FIG. 1, with the printer 1, one sheet S (web) for which both ends are wound in roll form on a delivery shaft 20 and a winding shaft 40 is stretched along a conveyance path Pc, and the sheet S undergoes image recording while being conveyed in a conveyance direction Df facing from the delivery shaft 20 to the winding shaft 40. The sheet S types are roughly divided into paper and film. To list specific examples, for paper, there is high quality paper, cast paper, art paper, coated paper and the like, and for film, there is synthetic paper, PET (polyethylene terephthalate), PP (polypropylene) and the like. Schematically, the printer 1 is equipped with a delivery part 2 (delivery area) that delivers the sheet S from the delivery shaft 20, a processing part 3 (processing area) that records an image on the sheet S delivered from the delivery part 2, and a winding part 4 (winding area) that winds the sheet S on which the image is recorded by the processing part 3 by the winding shaft 40. With the description hereafter, of the two surfaces of the sheet S, the surface on which the image is recorded is called the front surface, and the reverse side surface to that is called the back surface.

The delivery part 2 has the delivery shaft 20 on which the end of the sheet S is wound, and a driven roller 21 that winds the sheet S pulled from the delivery shaft 20. In a state with the front surface of the sheet S facing the outside, the delivery shaft 20 winds and supports the end of the sheet S. Also, by rotating the delivery shaft 20 clockwise in FIG. 1, the sheet S wound on the delivery shaft 20 is delivered via the driven roller 21 to the processing part 3. Incidentally, the sheet S is wound on the delivery shaft 20 via a core tube 22 that can be attached and detached with the delivery shaft 20. Therefore, when the sheet S of the delivery shaft 20 is used up, a new core tube 22 on which the sheet S is wound in roll form is mounted on the delivery shaft 20, making it possible to replace the sheet S of the delivery shaft 20.

The processing part 3 performs processing as appropriate using each functional unit 51, 52, 61, 62, and 63 arranged along the outer circumference surface of a rotating drum 30 while supporting the sheet S delivered from the delivery part 2 on the rotating drum 30, and records an image on the sheet S. With this processing part 3, a forward drive roller 31 and a rear drive roller 32 are provided at both sides of the rotating drum 30, the sheet S conveyed from the forward drive roller 31 to the rear drive roller 32 is supported on the rotating drum 30, and it undergoes image recording.

The forward drive roller 31 has a plurality of minute projections formed by thermal spraying on the outer circumference surface, and the sheet S delivered from the delivery part 2 is wound from the back surface side. Also, by the forward drive roller 31 rotating clockwise in FIG. 1, the sheet S delivered from the delivery part 2 is conveyed to the downstream side of the conveyance direction Df. A nip roller 31*n* (driven roller) having an outer circumference surface formed using an elastic member, and having greater elasticity than the forward drive roller 31, faces opposite the forward drive roller 31. Here, as the elastic member, examples include rubber or PFA (tetrafluoro ethylene perfluoro alkyl vinyl ether copolymer or the like). This nip roller 31*n* is energized to the forward drive roller 31 side, and follows the conveyance of the sheet S to rotate while abutting the front surface of the sheet S with its outer circumference surface. In this way, by grasping the sheet S between the forward drive roller 31 and the nip roller 31*n*, frictional force is ensured between the forward drive roller 31 and the sheet S, and it is possible to reliably perform conveying of the sheet S by the forward drive roller 31.

The rotating drum 30 is supported so as to be able to rotate in both directions of the conveyance direction Df and the reverse direction to that Db using a support mechanism (not illustrated), and for example is a cylindrical shaped drum having a diameter of 400 mm, and the sheet S conveyed from the forward drive roller 31 to the rear drive roller 32 is wound from the back surface side. This rotating drum 30 is an item that receives friction force with the sheet S, and supports the sheet S from the back surface side while doing following (driven) rotation with the sheet S. Incidentally, with the processing part 3, driven rollers 33 and 34 that fold back the sheet S are provided at both sides of the winding part onto the rotating drum 30. Of these, the driven roller 33 winds the front surface of the sheet S between the forward drive roller 31 and the rotating drum 30, and folds back the sheet S. Meanwhile, the driven roller 34 winds the front surface of the sheet S between the rotating drum 30 and the rear drive roller 32, and folds back the sheet S. In this way, by folding back the sheet S respectively at the upstream and downstream side of the conveyance direction Df in relation to the rotating drum 30, it is possible to ensure a long winding part of the sheet S onto the rotating drum 30.

The rear drive roller 32 has a plurality of minute projections formed using thermal spraying on the outer circumference surface, and the sheet S conveyed via the drive roller 34 from the rotating drum 30 is wound from the back surface side. Also, by the rear drive roller 32 rotating clockwise in FIG. 1, the sheet S is conveyed to the winding part 4 of the downstream side of the conveyance direction Df. A nip roller 32*n* (driven roller) having an outer circumference surface formed using an elastic member, and having greater elasticity than the rear drive roller 32, faces opposite the rear drive roller 32. Here, as the elastic member, examples include rubber, PFA or the like. This nip roller 32*n* is energized to the rear drive roller 32 side, and rotates following the conveying of the sheet S while abutting the front surface of the sheet S with its outer circumference surface. By the sheet S being grasped between the rear drive roller 32 and the nip roller 32*n* in this way, friction force between the rear drive roller 32 and the sheet S is ensured, and it is possible to reliably perform conveyance of the sheet S by the rear drive roller 32.

In this way, the sheet S conveyed from the forward drive roller 31 to the rear drive roller 32 is supported on the outer circumference surface of the rotating drum 30. Also, with the processing part 3, a plurality of recording heads 51 corresponding to mutually different colors are provided for recording a color image on the front surface of the sheet S supported on the rotating drum 30. In specific terms, four recording heads 51 corresponding to yellow, cyan, magenta, and black are aligned in the conveyance direction Df in this color sequence. Each recording head 51 faces the surface of the sheet S rolled onto the rotating drum 30 with a slight clearance left open, and ink of the corresponding color (colored ink) is discharged from the nozzle using the inkjet method. Then, by ink being discharged by each recording head 51 on the sheet S conveyed in the conveyance direction Df, a color image is formed on the surface of the sheet S.

Incidentally, as the ink, UV (ultraviolet) ink that is cured by the irradiation of ultraviolet rays (light) (photocurable ink) is used. In light of that, with the processing part 3, to cure the ink and fix it to the sheet S, UV irradiators 61 and 62 (irradiation units) are provided. This ink curing is executed divided into two stages of preliminary curing and main curing. The UV irradiators 61 for preliminary curing are arranged between each of the plurality of recording heads 51. In other words, the UV irradiators 61, by irradiating ultraviolet light of weak irradiation strength, cure the ink to a level for which the ink wetting and spreading is sufficiently slow (preliminary curing) compared to when ultraviolet light is not irradiated, and do not do main curing of the ink. On the other hand, the UV irradiator 62 for doing main curing is provided at the downstream side of the conveyance direction Df in relation to the plurality of recording heads 51. In other words, the UV irradiator 62 does curing to the level at which the ink wetting and spreading is stopped (main curing) by irradiating ultraviolet light of a stronger irradiation strength than the UV irradiators 61.

In this way, the UV irradiators 61 arranged between each of the plurality of recording heads 51 do preliminary curing of the colored ink discharged on the sheet S from the recording heads 51 on the upstream side of the conveyance direction Df. Therefore, the ink discharged on the sheet S by one recording head 51 undergoes preliminary curing by the time it reaches the adjacent recording head 51 to the one recording head 51 at the downstream side of the conveyance direction Df. By doing this, the occurrence of mixed colors by which colored inks of different colors are mixed together is suppressed. In this kind of state with mixed colors suppressed, the plurality of recording heads 51 discharge colored inks having mutually different colors, and form a color image on the sheet S. The UV irradiator 62 for main curing is provided further to the downstream side in the conveyance direction Df than the plurality of recording heads 51. Because of that, the color image formed using the plurality of recording heads 51 undergoes main curing by the UV irradiator 62 and is fixed on the sheet S.

Furthermore, the recording head 52 is provided at the downstream side of the conveyance direction Df in relation to the UV irradiator 62. This recording head 52 faces opposite the surface of the sheet S rolled onto the rotating drum 30 with a slight clearance left open, and discharges transparent UV ink onto the surface of the sheet S from nozzles using the inkjet method. In other words, transparent ink is further discharged onto the color image formed using the four colors of recording heads 51. This transparent ink is discharged on the entire surface of the color image, and gives the color image a feeling of glossiness or matte finish. Also, a UV irradiator 63 (irradiation unit) is provided to the downstream side of the conveyance direction Df in relation to the recording head 52. By this UV irradiator 63 irradiating strong ultraviolet light, it does main curing of the transparent ink discharged by the recording head 52. By doing this, it is possible to fix the transparent ink to the sheet S front surface.

In this way, with the processing part 3, ink discharge and curing are suitably executed on the sheet S wound onto the outer circumference part of the rotating drum 30, and a color image coated with transparent ink is formed. Then, the sheet S on which this color image is formed is conveyed to the winding part 4 by the rear drive roller 32.

In addition to the winding shaft 40 on which the end of the sheet S is wound, this winding part 4 has a driven roller 41 on which the sheet S is wound from the back surface side between the winding shaft 40 and the rear drive roller 32. In a state with the front surface of the sheet S facing the outside, the winding shaft 40 winds up and supports the end of the sheet S. In other words, when the winding shaft 40 rotates in rotation direction Cf (clockwise in FIG. 1), the sheet S conveyed from the rear drive roller 32 is wound onto the winding shaft 40 via the driven roller 41. Incidentally, the sheet S is wound onto the winding shaft 40 via a core tube 42 that can be attached and detached with the winding shaft 40. Therefore, it is possible to remove the sheet S for each core tube 42 when the sheet S wound onto the winding shaft 40 becomes full.

Also, the printer 1 is equipped with a mark sensor Sm facing opposite the surface of the sheet S between the nip roller 31*n* and the driven roller 33. In other words, of the surface of the sheet S, at the outside of the image recording area, a plurality of alignment marks are aligned at an even pitch in a conveyance direction Df, and the mark sensor Sm detects the alignment marks that pass through that detection area. Also, as will be described later, the conveying of the sheet S is controlled based on the detection results of the mark sensor Sm.

Figure 2:
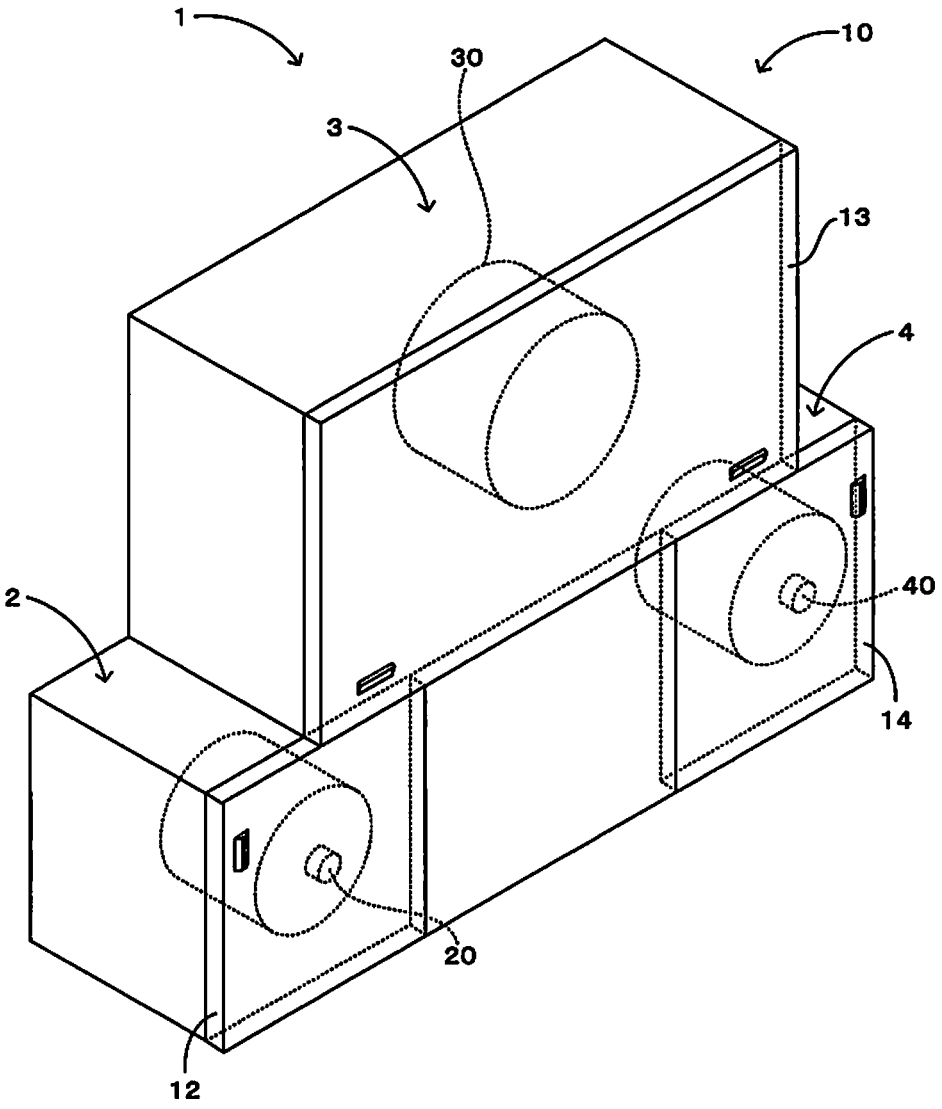

Furthermore, the printer 1 is equipped with an exterior member 10, and the constitution noted above shown in FIG. 1 is housed inside the exterior member 10 (FIG. 2). Here, FIG. 2 is a perspective view schematically showing the exterior member that the printer is equipped with, and in that drawing, the parts of the constitution housed in the exterior member 10 (delivery shaft 20, rotating drum 30, and winding shaft 40) are shown with a dotted line. The exterior member 10 is equipped respectively with doors 12, 13, and 14 facing opposite the delivery part 2, the processing part 3, and the winding part 4. Therefore, the user is able to access the delivery part 2, the processing part 3, and the winding part 4 by opening the doors 12, 13, and 14.

Figure 3:
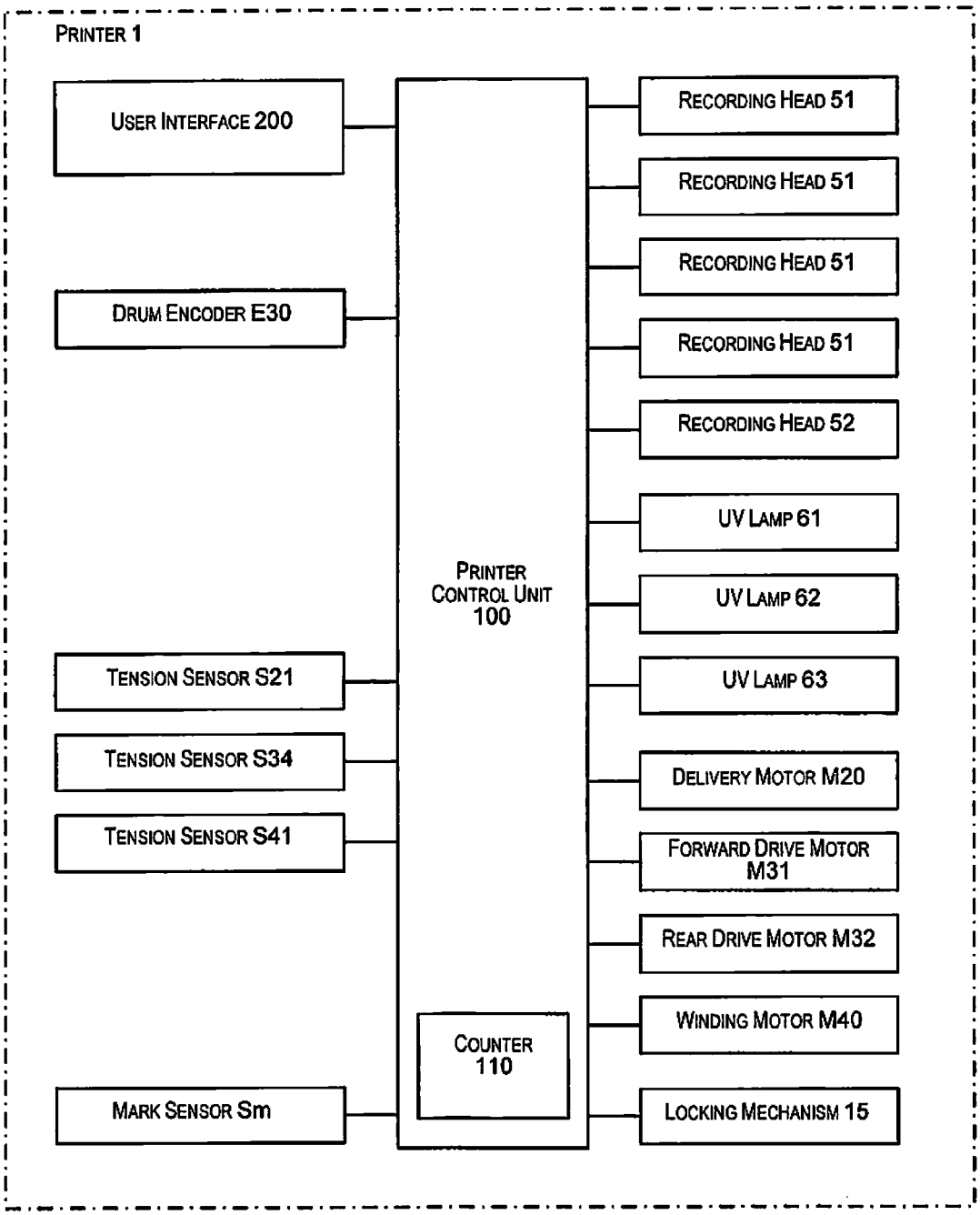
FIG. 3 is a block diagram schematically showing the electrical configuration for controlling the printer shown in FIG. 1.

The above is a summary of the device configuration of the printer 1. Following, we will describe the electrical configuration for controlling the printer 1. FIG. 3 is a block diagram schematically showing the electrical configuration for controlling the printer shown in FIG. 1. The printer 1 is equipped with a printer control unit 100 for controlling each part of the printer 1. In specific terms, the printer control unit 100 executes the following kind of control.

The printer control unit 100 receives input from the user and displays operation status of the printer 1 to the user via a user interface 200 that the printer 1 is equipped with. As the user interface 200, for example, it is possible to use a display having a touch panel function or the like, for example. When an instruction is input from the user, the user interface 200 transmits that instruction to the user interface 200. Then, the printer control unit 100 has an operation executed by each part of the printer 1 according to the received instruction.

Also, the printer control unit 100 manages controlling of locking and unlocking the doors 12, 13, and 14 of the exterior member 10. In specific terms, the printer control unit 100 locks or unlocks the doors 12, 13, and 14 by controlling a locking mechanism 15 consisting of an electromagnetic lock attached respectively to the doors 12, 13, and 14. In other words, by the user inputting an unlock instruction to the user interface 200, the user interface 200 transmits an unlock instruction to the locking mechanism 15. Having received this, the printer control unit 100 sends an unlocking signal to the locking mechanism 15, and unlocks the doors 12, 13, and 14. Meanwhile, when the user inputs a locking instruction to the user interface 200, the user interface 200 transmits a locking instruction to the printer control unit 100. Having received this, the printer control unit 100 sends a locking signal to the locking mechanism 15, and locks the doors 12, 13, 14. The printer control unit 100 locks the doors 12, 13, and 14 when starting conveying of the sheet S regardless of an instruction from the user.

The printer control unit 100 controls the ink discharge timing of each recording head 51 for forming color images according to the conveyance of the sheet S. More specifically, this ink discharge timing control is executed based on the output (detection value) of a drum encoder E30 that is attached to the rotating shaft of the rotating drum 30 and detects the rotation position of the rotating drum 30. In other words, the rotating drum 30 does following rotation following the conveyance of the sheet S, so if the output of the drum encoder E30 that detects the rotation position of the rotating drum 30 is referenced, it is possible to know the conveyance position of the sheet S. In light of that, the printer control unit 100 generates pts (print timing signal) signals from the output of the drum encoder E30, and by controlling the ink discharge timing of each recording head 51 based on the pts signal, the ink discharged by each recording head 51 is made to impact target positions on the conveyed sheet S, and a color image is formed.

Also, the timing for the recording head 52 to discharge the transparent ink is similarly controlled by the printer control unit 100 based on the output of the drum encoder E30. By doing this, it is possible to suitably discharge transparent ink on the color image formed by the plurality of recording heads 51. Furthermore, the light on and off timing and the irradiated light amount of the UV irradiators 61, 62, and 63 are also controlled by the printer control unit 100.

Also, the printer control unit 100 is in charge of the function of controlling the conveyance of the sheet S described in detail using FIG. 1. In other words, of the members constituting the sheet conveyance system, a motor is connected respectively to the delivery shaft 20, the forward drive roller 31, the rear drive roller 32, and the winding shaft 40. Also, the printer control unit 100 controls the speed and torque of each motor while rotating these motors, and controls the conveyance of sheet S. The details of this sheet S conveyance control are as noted hereafter.

The printer control unit 100 rotates a delivery motor M20 that drives the delivery shaft 20 and supplies the sheet S from the delivery shaft 20 to the forward drive roller 31. At this time, the printer control unit 100 controls the torque of the delivery motor M20, and adjusts the sheet S tension (delivery tension Ta) from the delivery shaft 20 to the forward drive roller 31. In other words, a tension sensor S21 that detects the size of the delivery tension Ta is attached to the driven roller 21 arranged between the delivery shaft 20 and the forward drive roller 31. This tension sensor S21 can be constituted by load cells that detect the size of the force received from the sheet S, for example. Also, the printer control unit 100 performs feedback control of the torque of the delivery motor M20 based on the detection results (detection value) of the tension sensor S21 and adjusts the delivery tension Ta of the sheet S.

Also, the printer control unit 100 rotates the forward drive motor M31 that drives the forward drive roller 31 and the rear drive motor M32 that drives the rear drive roller 32. By doing this, the sheet S delivered from the delivery part 2 passes through the processing part 3. At this time, while speed control is executed on the forward drive motor M31, torque control is executed on the rear drive motor M32. In other words, the printer control unit 100 adjusts the rotation speed of the forward drive motor M31 to be constant based on the encoder output of the forward drive motor M31. By doing this, the sheet S is conveyed at a constant speed by the forward drive roller 31.

Meanwhile, the printer control unit 100 adjusts the tension of the sheet S (process tension Tb) from the forward drive roller 31 to the rear drive roller 32 by controlling the torque of the rear drive motor M32. In other words, a tension sensor S34 that detects the size of the process tension Tb is attached to the driven roller 34 arranged between the rotating drum 30 and the rear drive roller 32. This tension sensor S34 can for example be constituted using load cells that detect the size of the force received from the sheet S. Also, the printer control unit 100 adjusts the process tension Tb of the sheet S by doing feedback control of the torque of the rear drive motor M32 based on the detection results (detection value) of the tension sensor S34.

Also, the printer control unit 100 rotates the winding motor M40 that drives the winding shaft 40, and winds the sheet S conveyed by the rear drive roller 32 onto the winding shaft 40. At this time, the printer control unit 100 controls the torque of the winding motor M40 and adjusts the tension of the sheet S (winding tension Tc) from the rear drive roller 32 to the winding shaft 40. In other words, a tension sensor S41 that detects the size of the winding tension Tc is attached to the driven roller 41 arranged between the rear drive roller 32 and the winding shaft 40. This tension sensor S41 can be constituted, for example, by load cells that detect the size of the force received from the sheet S. Also, the printer control unit 100 performs feedback control of the torque of the winding motor M40 based on the detection results (detection value) of the tension sensor S41 and adjusts the winding tension Tc of the sheet S.

In this way, the printer control unit 100 records an image on the sheet S using recording heads 51 and 52 while conveying the sheet S in the conveyance direction Df toward the winding shaft 40 from the delivery shaft 20. At this time, the printer control unit 100 knows the conveyance amount of the sheet S based on the detection results of the mark sensor Sm. In other words, the printer control unit 100 has a counter 110, and each time the mark sensor Sm detects an alignment mark that passes through in the conveyance direction Df along with conveyance of the sheet S, the count value of the counter 110 is incremented. By doing this, it is possible to know the conveyance amount of the sheet S in the conveyance direction Df from the count value of the counter 110.

With this embodiment, the printer control unit 100 conveys the sheet S in the conveyance direction Df not only with forward conveying, but it is also possible to execute reverse conveying that conveys the sheet S in the conveyance direction Db (specifically, the direction reverse to that of the conveyance direction DO facing the delivery shaft 20 from the winding shaft 40. In specific terms, by controlling each motor M20, M31, M32, and M40, the rotation of the delivery shaft 20, the forward drive roller 31, the rear drive roller 32, and the winding shaft 40 is done in the reverse direction to when doing forward conveying, and reverse conveying is executed. At this time, the printer control unit 100 knows the conveyance amount of the sheet S with reverse conveying based on the detection results of the mark sensor Sm. In other words, each time the mark sensor Sm detects an alignment mark passing through in the conveyance direction Db along with conveying of the sheet S, the count value of the counter 110 is decremented. By doing this, it is possible to know the conveyance amount of the sheet S in the conveyance direction Db from the count value of the counter 110.

Figure 4:
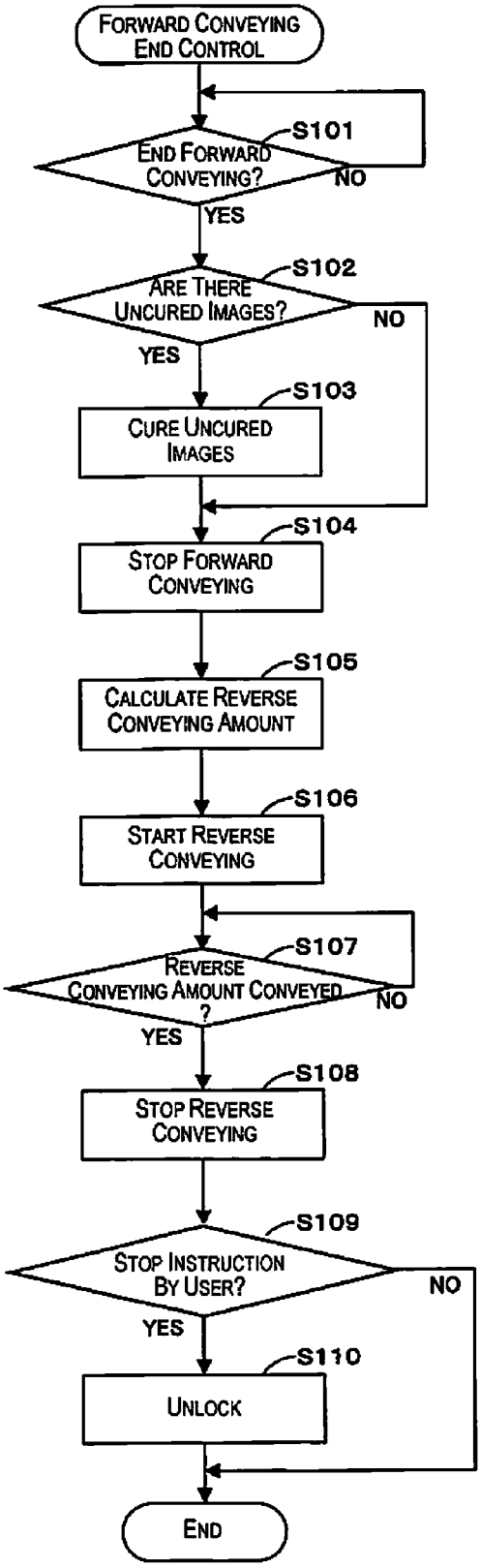
FIG. 4 is a flow chart showing an example of the forward conveying end control executed by the printer control unit.
Figures 5, 6:
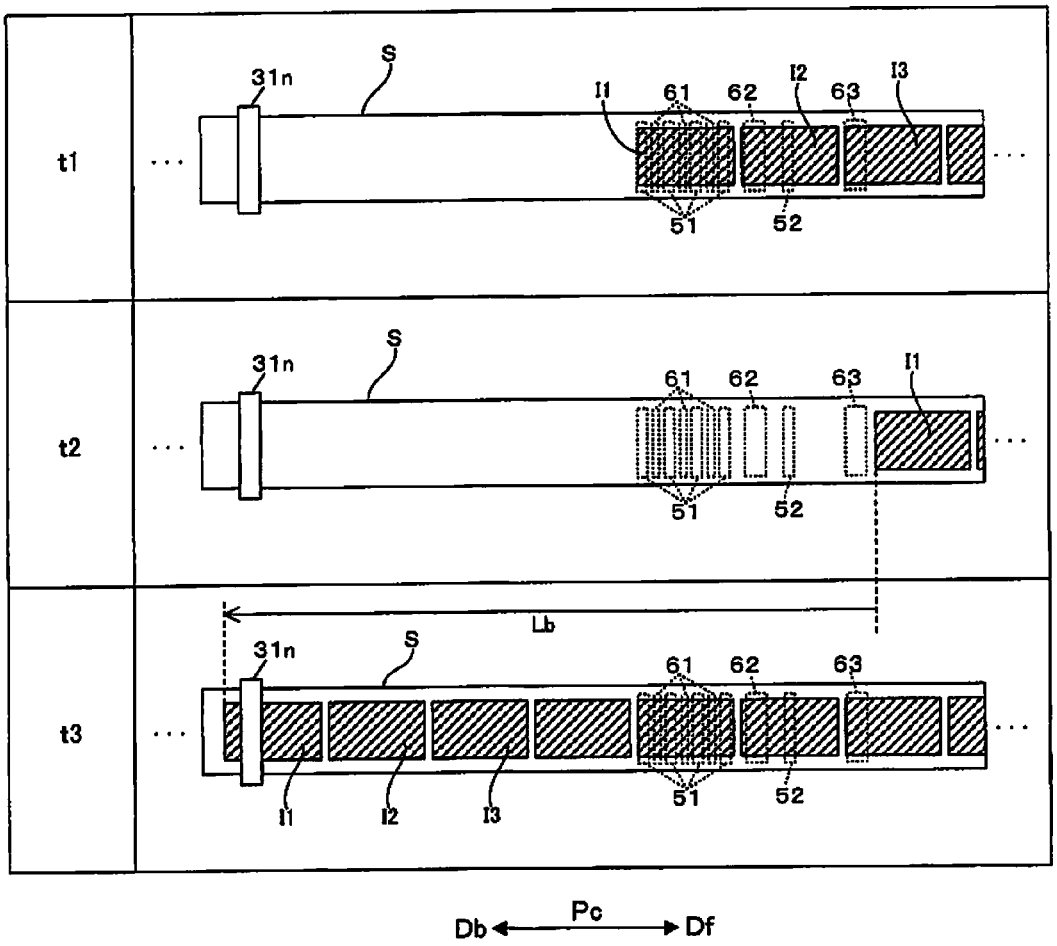
FIG. 5 is a drawing schematically showing the operation executed according to the flow chart of FIG. 4.
FIG. 6 is a drawing showing the results of testing the relationship between the nip load, nip time, and nip marks.

In particular with this embodiment, the printer control unit 100 stops the sheet S after executing reverse conveying when the forward conveying has ended. FIG. 4 is a flow chart showing an example of the forward conveying end control executed by the printer control unit. FIG. 5 is a drawing schematically showing an example of the operation executed according to the flow chart of FIG. 4, and shows the state of deployment along the conveyance path Pc. In particular with FIG. 5, the sheet S conveyance state is shown with the time series t1, t2, and t3.

At step S101, a judgment is made of whether or not to end the forward conveying that is midway in execution. Then, when ending the forward conveying of the sheet S, it is determined to end forward conveying (step S101 "Yes"), and the process proceeds to step S102. In specific terms, for example when forward conveying stops along with completion of image recording on the sheet S, when forward conveying is forcibly stopped according to a stop instruction input from the user or the like, a judgment is made to end forward conveying at step S101.

At step S102, a judgment is made of whether there is an uncured image on the sheet S. Then, when there is no uncured image (when "No" at step S102), the process proceeds to step S104 and forward conveying of the sheet S stops. On the other hand, when there is an uncured image (when "Yes" at step S102), forward conveying of the sheet S is continued until that uncured image passes under the main curing UV irradiator 63, and curing (main curing) of the uncured image is executed (step S103). Then, after curing of all the images is completed, the process proceeds to step S104, and forward conveying of the sheet S is stopped. For example, with the example in FIG. 5, after forward conveying has continued in the conveyance direction Df until the image I1 formed finally at time t1 has passed under the UV irradiator 63, forward conveying is stopped (time t2).

At step S105, a reverse conveying amount Lb necessary to position the image I1 between the forward drive roller 31 and the nip roller 31*n* is calculated. Next, together with starting reverse conveying of the sheet S (step S106), a judgment is made of whether or not conveying is completed of the reverse conveying amount Lb (step S107) based on the count value of the counter 110. Then, when conveying of the reverse conveying amount Lb is completed ("Yes" at step S107), reverse conveying is stopped at step S108. In this way, the sheet S conveying is stopped in a state with the image I1 positioned between the forward drive roller 31 and the nip roller 31*n* (time t3).

Next, at step S109, a judgment is made of whether or not the reason that it was determined to end forward conveying at step S101 was due to a stop instruction from the user. Then, when the reason was other than a stop instruction from a user (when "No" at step S109), the flow chart of FIG. 4 ends with the locks left in place for doors 12, 13, and 14. On the other hand, when a stop instruction from the user was the reason (when "Yes" at step S109), after the doors 12, 13, and 14 are unlocked (step S110), the flow chart of FIG. 4 ends.

With this embodiment as described above, while conveying the sheet S grasped between the forward drive roller 31 and the nip roller 31*n* in the conveyance direction Df, an image is recorded on the sheet S by the recording heads 51 and 52 arranged further to the downstream side in the conveyance direction Df than the forward drive roller 31. With this constitution, when conveying of the sheet S in the conveyance direction Df stops, the unrecorded sheet S is stopped between the forward drive roller 31 and the nip roller 31*n*. Because of that, when the time for which the sheet S conveyance is stopped becomes long, there are cases when there is degeneration of the unrecorded recording media positioned between the drive roller and the nip roller. As a result, there is the risk that a problem will occur that it is not possible to do good recording of the image on the degenerated part with the image recording after that, and that streak marks (nip marks) will be visible with the image recorded on the degenerated part (specifically, the problem of a decrease in image quality).

Various causes have been inferred for causing these nip marks. Specific examples include the possibility of an electrical charge due to contact for a long time of the surface of the sheet S on the nip roller 31*n*, leading to degeneration. Alternatively, as will be described in detail next, it is also possible to have degeneration of the surface of the sheet S caused by a component expressed from the nip roller 31*n*.

For example, when using a rubber roller as the nip roller 31*n*, a rubber component is expressed to the outer circumference surface of the nip roller 31*n* due to a phenomenon of so-called bleeding. Therefore, when conveying of the sheet S is stopped for a fixed time or greater, a large amount of the component expressed from the rubber adheres to the part in contact with the nip roller 13*n* of the sheet S, and there is degeneration of the sheet S at that part. As a result, when performing image recording on the sheet S after that, the qualitative sense of the image of the degenerated part is different from the qualitative sense of the image at the other parts, and there were cases when the image recorded at the degenerated part was visible as streak marks (nip marks). Also, when using a PFA roller as the nip roller 31*n* as well, there were also cases when nip marks were visible which were possibly attributable to components expressed from the nip roller 31*n*.

Nip marks that occur due to that reason are thought to have a trend of appearing especially markedly on sheets S having a film base material more than sheets S having a paper base material. In other words, with the sheet S having a paper type base material, the component expressed from the outer circumference surface of the nip roller 31*n* is soaked into the base material and absorbed, so the wettability of the base material surface does not worsen that much, and the nip mark does not stand out. On the other hand, with the sheet S having a film type base material, the component expressed from the outer circumference surface of the nip roller 31*n* does not soak into the base material, so the wettability of the base material surface worsens, and the nip mark is marked.

With this embodiment in relation to this kind of nip mark problem, when the conveying of the sheet S in the conveyance direction Df (forward conveying) stops, conveying of the sheet S in the conveyance direction Db which is the reverse direction to the conveyance direction Df starts. Then, in a state with the image I1 recorded on the sheet S positioned between the forward drive roller 31 and the nip roller 31*n*, the conveying of the sheet S in the conveyance direction Db stops. Therefore, the time for which the unrecorded sheet S is stopped between the forward drive roller 31 and the nip roller 31*n* can be inhibited to the time from when the conveying in the conveyance direction Df stops until the start of conveying in the conveyance direction Db. As a result, degeneration of the unrecorded sheet S can be suppressed, and it is possible to inhibit the occurrence of nip marks on the sheet S.

Also, with this embodiment, when the reason for stopping forward conveying was a stop instruction from the user, the doors 12, 13, and 14 were locked until reverse conveying stopped, and the doors 12, 13, and 14 were unlocked after reverse conveying stopped. With this constitution, it is possible to prevent the user from accessing the inside of the exterior member 10 by locking the doors 12, 13, 14 until the reverse conveying stops, and after the reverse conveying has stopped, it is possible for the user to execute the desired task on the interior of the exterior member.

Also, with this embodiment, when stopping forward conveying, when there is an uncured image on the sheet S, forward conveying is stopped after curing the uncured image. Therefore, the image I1 positioned between the forward drive roller 31 and the nip roller 31*n* by reverse conveying after that is cured by the irradiation of light. Thus, it is possible to inhibit dirtying of the nip roller 31*n* due to contact by the uncured mage I1. Also, the image after curing is not affected by the component expressed from the nip roller 31*n*, so there is no degeneration of the image I1.

As described above, with this embodiment, the printer 1 correlates to an example of the "image recording device" of the present invention, the forward drive roller 31 correlates to an example of the "drive roller" of the present invention, the nip roller 31*n* correlates to an example of the "driven roller" of the present invention, the printer control unit 100 correlates to an example of the "control unit" of the present invention, the sheet S correlates to an example of the "recording media" of the present invention, the conveyance direction Df correlates to an example of the "first direction" of the present invention, and the conveyance direction Db correlates to an example of the "second direction" of the present invention. Also, the exterior member 10 correlates to an example of the "exterior member" of the present invention, doors 12, 13, and 14 respectively correlate to an example of the "doors" of the present invention, the locking mechanism 15 correlates to an example of the "locking mechanism" of the present invention, the user interface 200 correlates to an example of the "user interface" of the present invention, and the UV irradiators 61 and 62 correlate to an example of the "irradiation unit" of the present invention.

The present invention is not limited to the embodiment noted above, and it is possible to add various modifications to the item described above as long as it does not stray from the gist. For example, when grasping the sheet S between the forward drive roller 31 and the nip roller 31*n* as noted with the embodiment above, a nip load is applied to the sheet S. There is no specific numerical value mentioned for this nip load, but for example if the nip load is set from 86 N to 128 N, it is possible to relatively stably perform conveying of various sheets S. At this time, as the nip roller 31*n*, for example it is possible to use the PFA roller described above.

Also, with the embodiment noted above, there was no specific mention regarding specific numerical values for the time from when the forward conveying stops until the reverse conveying starts, said another way, the nip time during which the stopped sheet S is grasped between the forward drive roller 31 and the nip roller 31*n*. However, it is possible to suitably set individual values for this nip time as well.

FIG. 6 is a drawing showing in table form the results of testing the relationship between nip load, nip time, and nip marks. In this drawing, shown are the results of confirming by eye the nip marks formed an image of cyan single color with printing duty of 50% after grasping of the sheet S of #76911 made by Avery Dennison Corp. between the forward drive roller 31 and the nip roller 31*n* for each nip time at each nip load. From these test results, the nip load of 86 N to 128 N described above, specifically when a nip load of about 100 N is given to the sheet S, we can see that it is preferable to have the nip time be 10 seconds or less, and more preferably to be 2.5 seconds or less. In particular, when the nip time is set to 2.5 seconds or less, the nip mark cannot be confirmed with the naked eye. In other words, if reverse conveying starts within 2.5 seconds after forward conveying starts, the unrecorded sheet S time of stopping between the forward drive roller 31 and the nip roller 31*n* can be inhibited to within 2.5 seconds or less, and it is possible to more reliably suppress the occurrence of nip marks.

Also, with the embodiment noted above, as reasons for stopping of the forward conveying, examples were shown of when image recording is completed, and when there is a stop instruction by the user. However, it is possible to use the present invention even in a case when stopping the forward conveying due to reasons other than these.

In light of that, it is also possible to use the present invention when forward conveying ends when performing maintenance such as cleaning and wiping, for example. In specific terms, reverse conveying is performed after forward conveying ends, and the image recorded on the sheet S is positioned between the forward drive roller 31 and the nip roller 31*n*. Then, it is also possible to execute maintenance in parallel with reverse conveying or after reverse conveying stops. Here, cleaning is an operation of forcibly exhausting ink from the nozzles of the recording heads 51 and 52, and wiping is an operation of wiping the surface on which nozzles are formed of the recording heads 51 and 52 using a wiper. These maintenances are executed in a state with the recording heads 51 and 52 moved to a maintenance position (not illustrated) provided adjacent to the rotating drum 30 in the direction perpendicular to the paper surface in FIG. 1.

Alternatively, it is also possible to use the present invention when the forward conveying ends when confirming the ink discharge state from the nozzles of the recording heads 51 and 52. In specific terms, reverse conveying is performed after the forward conveying ends, and the image recorded on the sheet S is positioned between the forward drive roller 31 and the nip roller 31*n*. It is also possible to execute confirmation of the ink discharge state in parallel with the reverse conveying or after reverse conveying stops. Confirmation of the ink discharge state can be performed using a method based on residual vibration of a vibrating plate that applies pressure within the nozzles of the recording heads 51 and 52 such as with Patent Publication No. 3794431, for example. At this time, confirmation of the ink discharge state can be executed with the recording heads 51 and 52 as is facing opposite the rotating drum 30 when there is no discharge of ink from the nozzles, or can be executed after moving the recording heads 51 and 52 to the maintenance position described above when there is discharge of ink from the nozzles.

Also, with the embodiment noted above, when stopping the forward conveying, the forward conveying was stopped after curing the uncured image. At this time, it is not necessary to do main curing of the image I1 that exists on the sheet S, and it is sufficient to cure the image I1 to the level at which the image I1 will not transfer to the nip roller 31*n* when the image I1 contacts the nip roller 31*n*.

Also, with the embodiment noted above, by controlling the reverse conveying amount of the sheet S based on the alignment marks provided on the sheet S, the image I1 was positioned between the forward drive roller 31. However, it is also possible to have the constitution such that for example by controlling the reverse conveying amount of the sheet S based on the detection results of the sensor that detects the image between the forward drive roller 31 and the nip roller 31*n*, the image I1 is positioned between the forward drive roller 31 and the nip roller 31*n*.

Also, with the embodiment noted above, the forward drive roller 31 contacted the back surface of the sheet S, and the nip roller 31*n* contacted the front surface of the sheet S. However, it is also possible to arrange the rollers 31 and 31*n* such that the forward drive roller 31 contacts the front surface of the sheet S, and the nip roller 31*n* contacts the back surface of the sheet S.

Also, with the embodiment noted above, an image was recorded by discharging UV ink on the recording heads 51 and 52. However, it is also possible to record an image by discharging water based ink from the recording heads 51 and 52.

Also, for the member that supports the sheet S as well, this is not limited to being a cylindrical shaped item such as the rotating drum 30 noted above. Therefore, it is also possible to use a flat type platen that supports the sheet S on a flat surface.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. An image recording device comprising:

a drive roller configured and arranged to convey a recording medium by rotating;

a driven roller configured and arranged with respect to the drive roller so that the recording medium is grasped between the drive roller and the driven roller;

a recording unit configured and arranged to record an image on the recording medium arranged further to a downstream side than the drive roller in a first direction which is a recording medium conveyance direction; and a control unit configured to control the recording unit and the drive roller to record the image on the recording medium while conveying the recording medium in the first direction, wherein the control unit is configured to control the recording unit and the drive roller to stop conveying of the recording medium in the first direction, to calculate a reverse conveying amount necessary to position the image recorded on the recording medium between the drive roller and the driven roller, to start conveying the recording medium in a second direction which is a reverse direction of the first direction, and to stop conveying of the recording medium when the recording medium has been conveyed by the reverse conveying amount in the second direction and in a state in which the image recorded on the recording medium is positioned between the drive roller and the driven roller.

2. The image recording device according to claim 1, wherein the control unit is configured to control the drive roller to start conveying the recording medium in the second direction within 2.5 seconds after conveying of the recording medium in the first direction stops.

3. The image recording device according to claim 1, further comprising:

an exterior member housing the drive roller, the driven roller, and the recording unit;

a door provided on the exterior member;

a locking mechanism configured and arranged to lock the door; and a user interface configured and arranged to receive instructions from a user and to transmit the instructions to the control unit, wherein the control unit is configured to control the drive roller to stop conveying of the recording medium in the first direction in accordance with a stop instruction from the user, to control the locking mechanism to lock the door until conveying of the recording medium in the second direction stops, and to unlock the door after conveying of the recording medium in the second direction has stopped.

4. The image recording device according to claim 1, further comprising an irradiation unit configured and arranged to irradiate light on the recording medium, wherein the recording unit is configured and arranged to discharge a photocurable liquid that is cured by irradiating the light to record the image on the recording medium, and the control unit is configured to control the recording unit, the drive roller and the irradiation unit to stop conveying of the recording medium in the first direction after having the image cured to a level at which the image will not transfer to the driven roller when the image contacts the driven roller, by irradiating the light from the irradiation unit on the image recorded on the recording medium by the recording unit.

5. The image recording device according to claim 1, wherein the driven roller has rubber on an outer circumference surface, and a surface of the recording medium on which the image is recorded is contacted by the outer circumference surface.

6. The image recording device of claim 1, wherein the driven roller has a tetrafluoro ethylene perfluoro alkyl vinyl ether copolymer on an outer circumference surface, and a surface of the recording medium on which the image is recorded is contacted by the outer circumference surface.

7. An image recording method comprising:

recording an image on a recording medium by a recording unit arranged further to a downstream side in a first direction than a drive roller while conveying the recording medium grasped between the drive roller and a driven roller in the first direction which is a conveyance direction of the recording medium;

calculating a reverse conveying amount necessary to position the image recorded on the recording medium between the drive roller and the driven roller;

starting conveying of the recording medium in a second direction which is a reverse direction of the first direction when conveying of the recording medium in the first direction stops; and stopping conveying of the recording medium in the second direction in a state in which the image recorded on the recording medium is positioned between the drive roller and the driven roller.

* * * * *